US008651893B2

(12) United States Patent
Ogura et al.

(10) Patent No.: US 8,651,893 B2
(45) Date of Patent: Feb. 18, 2014

(54) CONNECTOR

(75) Inventors: Yoshiyuki Ogura, Kanagawa (JP); Yasuyoshi Yoshikai, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 39 days.

(21) Appl. No.: 13/377,436

(22) PCT Filed: May 24, 2010

(86) PCT No.: PCT/JP2010/058717

§ 371 (c)(1), (2), (4) Date: Feb. 27, 2012

(87) PCT Pub. No.: WO2010/143519

PCT Pub. Date: Dec. 16, 2010

(65) Prior Publication Data

US 2012/0142223 A1 Jun. 7, 2012

(30) Foreign Application Priority Data

Jun. 10, 2009 (JP) ..... 2009-139400

(51) Int. Cl.
*H01R 12/24* (2006.01)

(52) U.S. Cl.
USPC ..... 439/495; 439/260

(58) Field of Classification Search
USPC ..... 439/495, 260, 67
See application file for complete search history.

(56) References Cited

U.S. PATENT DOCUMENTS 7,172,446 B1 * 2/2007 Hashimoto et al. ..... 439/260
7,255,584 B2 * 8/2007 Takashita ..... 439/260
7,275,948 B2 * 10/2007 Miura et al. ..... 439/260
7,601,017 B2 * 10/2009 Wang et al. ..... 439/260
2002/0098740 A1 7/2002 Ooya

FOREIGN PATENT DOCUMENTS

JP 2002-216914 A 8/2002
JP 2005-078908 A 3/2005
JP 2008-277068 A 11/2008
JP 2009-070757 A 4/2009

OTHER PUBLICATIONS

International Search Report for PCT/JP2010/058717 mailed Jun. 15, 2010.

* cited by examiner

*Primary Examiner* — Hien Vu
(74) *Attorney, Agent, or Firm* — Lowe Hauptman & Ham, LLP

(57) ABSTRACT

A connector arranged to prevent connection failure due to foreign matter trapped between contacts and a connectable object. The contacts have a first movable piece portion, the anterior end including a first contacting portion for contact with a flexible circuit, the posterior end pressable by a press member in a direction opposite the flexible circuit, a second movable piece portion, the anterior end including a second contacting portion for contact with the flexible circuit, the posterior end of first and second movable piece portions being integrally formed, and a springy piece portion for displacing the movable piece portions. Pressing the posterior end of the first movable piece portion by the press member causes the contacting portions to come into pressure contact with the flexible circuit. The contacting portions being brought into two-point contact with the flexible circuit by the press member pressing the contacts.

9 Claims, 9 Drawing Sheets

CONNECTOR

RELATED APPLICATIONS

The present application is a National Phase of International Application Number PCT/JP2010/058717, filed May 24, 2010 and claims priority from, Japanese Application Number 2009-139400, filed Jun. 10, 2009.

TECHNICAL FIELD

The present invention relates to a connector used to connect, for example, a flexible printed circuit (FPC) or a flexible flat cable (FFC).

BACKGROUND ART

As this type of connector, there has conventionally been known a connector provided with a connector main body into the front side of which one end of an object to be connected (referred to as a flexible circuit), such as an FPC or an FFC, can be inserted, a plurality of contacts disposed in the connector main body in the width direction thereof, and a freely rotatable press member for pressing the flexible circuit inserted into the connector main body toward respective contacts (see, for example, Patent Literature 1).

This connector is adapted so that, when the press member is rotated in one direction with the flexible circuit inserted into the connector main body, the flexible circuit and the respective contacts are brought into pressure contact and electrical conduction with each other by the press member and, when the press member is rotated in the other direction, pressure contact between the respective contacts and the flexible circuit is cancelled, thereby enabling the flexible circuit to be inserted/removed into/from the connector main body.

CITATION LIST

Patent Literature

[Patent Literature 1] Japanese Patent Publication 2005-78908

SUMMARY OF INVENTION

Technical Problem

However, the above-described connector has been problematic in that if foreign matter becomes trapped between the contacts and the flexible circuit at the time of connecting the flexible circuit in a case where, for example, the foreign matter adheres to the flexible circuit, the conduction state of the contacts and the flexible circuit is turned off by the foreign matter, thus causing a connection failure.

The present invention has been accomplished in view of the above-described problem, and an object of the invention is to provide a connector capable of effectively preventing a connection failure even if foreign matter becomes trapped between contacts and an object to be connected.

Solution to Problem

In order to achieve the aforementioned object, a connector of the present invention is provided with a connector main body into which an object to be connected is inserted, a plurality of contacts disposed at intervals from one another within the connector main body in the width direction thereof, and a freely rotatable press member for pressing respective contacts against the object to be connected inserted into the connector main body, wherein the press member is adapted to press the respective contacts toward the object to be connected when rotated in one direction and cancel the press of the respective contacts when rotated in the other direction, and the contacts are provided with a first movable piece portion at one end of which a first contacting portion for contact with the object to be connected is included and the other end of which is pressed by the press member in a direction opposite to the object to be connected, a second movable piece portion at one end of which a second contacting portion for contact with the object to be connected is included and the other end of which is formed integrally with the other end of the first movable piece portion, and a springy piece portion for displacing the first and second movable piece portions so that, when the other end of the first movable piece portion is pressed by the press member, the first and second contacting portions come into pressure contact with the object to be connected.

Consequently, when the contacts are pressed by the press member, one ends of the first and second movable piece portions are displaced toward the object to be connected and thus the first and second contacting portions come into two-point contact with the object to be connected.

Advantageous Effects of Invention

According to the present invention, the first and second contacting portions can be brought into two-point contact with the object to be connected by pressing the contacts by the press member. Consequently, even if foreign matter becomes trapped between one of the first and second contacting portions and the object to be connected, thus causing a contact failure, in a case where, for example, the foreign matter adheres to the object to be connected, it is possible to secure electrical conduction between the other contacting portion and the object to be connected. Thus, it is possible to effectively prevent a connection failure.

BEST MODE FOR CARRYING OUT THE INVENTION

Figure 1:
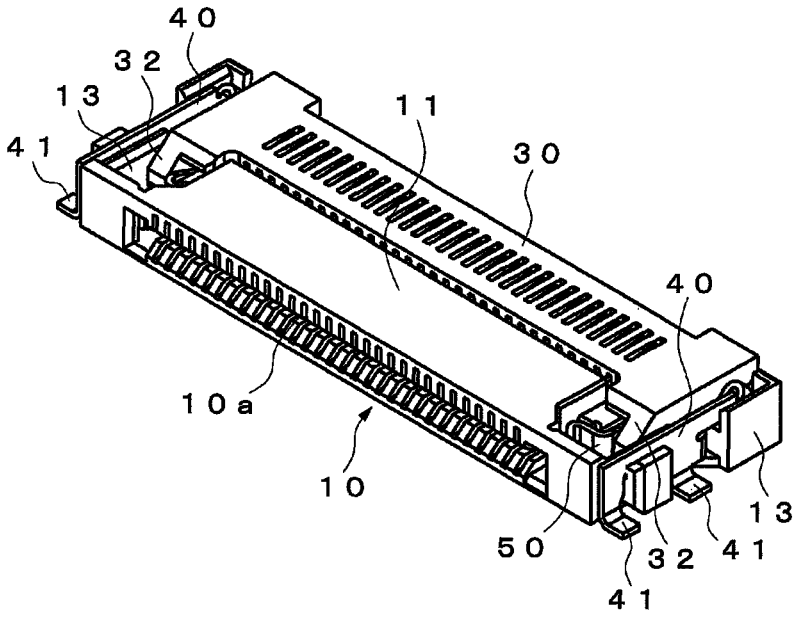
FIG. 1 is a front side perspective view of a closed state connector showing first embodiment of this invention.
Figure 2:
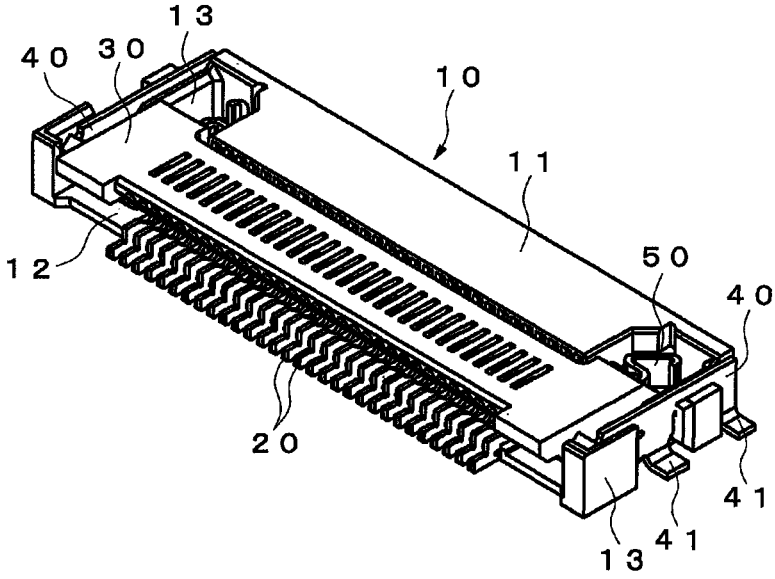
FIG. 2 is rear side perspective view of the closed state connector.
Figure 3:
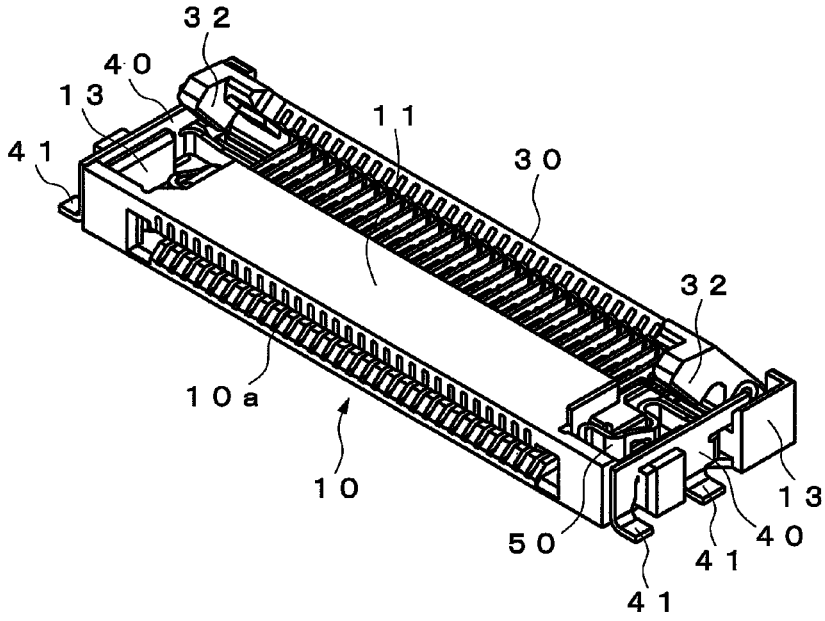
FIG. 3 is a front side perspective view of an opened state connector.
Figure 4:
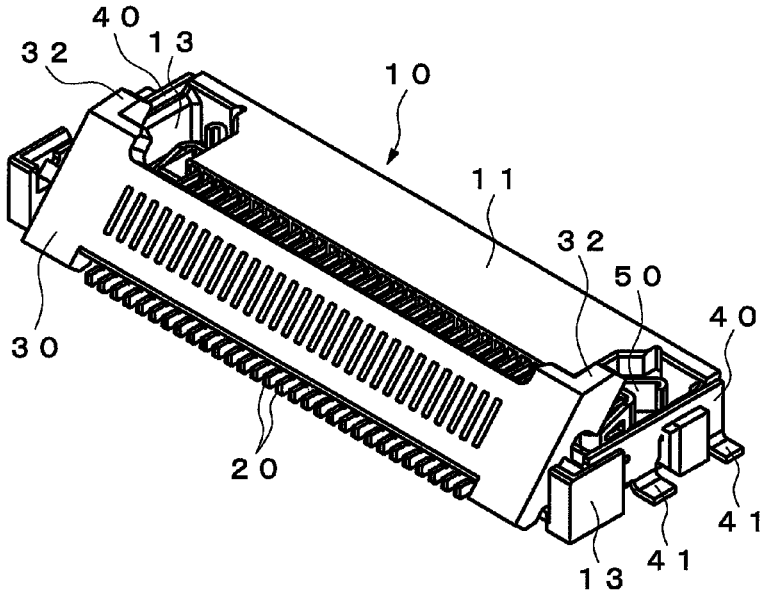
FIG. 4 is a rear side perspective view of the opened state connector.

FIGS. 1 through 11 show a first embodiment of the present invention. A connector shown in said FIGS. comprises a connector main body 10 into which a flexible circuit 1 to be inserted as an object to be connected, a plurality of contacts 20 arranged with spaces in the width direction of the connector main body 10, a press member 30 capable of rotating for pushing each contacts toward the flexible circuit 1 side which is inserted into the connector main body 10, a pair of left/right fixing members 40 for fixing the connector main body 10 to a circuit board which is not shown in any of FIGS., and a pair of left/right lock members 50 with which the flexible circuit 1 is engaged.

The flexible circuit 1 is configured of what is called a flexible flat cable (FFC) or a flexible printed circuit (FPC), a plurality of electrical metal terminals (not shown) is provided at an upper face of a tip side of the flexible circuit 1 with spaces in the width direction. Also, dented portions 1*a* as the engagement portion for being engaged with the lock members 50 is provided at both end sides in the width direction of the flexible circuit 1. When the flexible circuit 1 is inserted into a predetermined position of the connector main body 10 (position for connecting with the contacts 20), each of the lock members 50 is engaged with the dented portions respectively.

The connector main body 10 is made of a synthetic resin molding, and an insertion slot 10*a* for inserting the flexible circuit 1 is provided at a front face of the connector main body 10. The connector main body 10 comprises an upper face portion 11, a bottom face portion 12, and left and right side face portions 13, the upper face portion 11 is configured only at the front end side of the upper face of the connector main body 10. Also, both of the left and right sides of the upper face portion 11 are opened to expose the inside of the connector main body 10, and the lock members 50 are disposed at the exposed portions.

Each of the contacts 20 is made of a conductive metal plate which is arranged at the bottom face portion 12 of the connector main body 10 with spaces in the width direction. Each of the contacts 20 comprises a fixing piece portion 21 for fixing with the bottom face portion 12, a first movable piece portion 22 pushed by the press member 30, a second movable piece portion 23 arranged at the lower side of the first movable piece portion 22, and a springy piece portion 24 formed between the second movable portion 23 and the fixing piece portion 21.

The fixing piece portion 21 extends in the front-rear direction of the connector main body 10, a front end portion 21*a* thereof is pushed into a slit at the bottom face portion 12 side. A connecting portion 21*b* for connecting to a circuit board, which is not shown in any of FIGS., is provided at the rear end of the fixing piece portion 21, the connecting portion 21*b* extends toward backward of the connector main body 10. A first convex portion 21*c* capable of rotatably engaging with the press member 30 is provided at the rear end side of the fixing piece portion 21, and a first concave portion 21*d* is provided at the front side of the first convex portion 21*c*.

The first movable piece portion 22 extends in the vertical direction of the connector main body 10, a first contacting portion 22*a* for contacting the upper face of the flexible circuit 1 is provided so as to protrude downwardly at the front end of the movable piece portion 22. A first abutting portion 22*b* and a second abutting portion 22*c* for abutting against the press member 30 are provided at the rear end of the first movable piece portion 22, the first contacting portion 22*b* is provided at the rear end side of the first movable piece portion 22 downwardly inclining from upper side to the lower side, the second abutting portion 22*c* is formed approximately horizontally in the front-rear direction at the bottom end face of the first movable piece portion 22.

The second movable piece portion 23 extends toward the front-rear direction of the connector main body 10, a second contacting portion 23*a* for contacting the upper side of the flexible circuit 1 is provided to protrude downwardly at the front end of the second movable piece portion 23. In this embodiment, the second movable piece portion 23 is shorter than the first movable piece portion 22 in the front-rear direction of the connector main body 10, and the width of the second movable piece portion 23 is smaller in the front-rear direction than the width of the first movable piece portion 22. Also, the second contacting portion 23*a* is placed at the rear side of the first contacting portion 22*a*, the lower end of the second contacting portion 23*a* is the same height as the lower end of the first contacting portion 22*a* (contacting point). The rear end side of the second movable piece portion 23 bends upwardly and extends toward the rear end side of the first movable piece portion 22 (ahead of the second abutting portion 22*c*), the first movable piece portion 22 is supported by the rear end side of the second movable piece portion 23.

The springy piece portion 24 extends in the vertical direction from an approximate center in the front-rear direction of the fixing piece portion 21 to an approximate center in the front-rear direction of the second movable piece portion 23, the first movable piece portion 22 and the second movable piece portion 23 are respectively supported so that the front end sides and rear end sides of the first movable piece portion 22 and the second movable piece portion 23 are respectively movably in the vertical direction.

The press member 30 is made of a synthetic resin molding the press member 30 covers the upper face in the rear end side of the connector main body 10. A rotation support portion 31 protruding toward the inside of the connector main body 10 is provided at the rear end side of the press member 30. A second convex portion 31*a* for engaging with the first concave portion 21*c* of the contacts 20 is provided at the tip of the rotation support portion 31. A second convex portion 31*b* for engaging with the first concave portion 21*d* of the contacts 20 is provided at the front part of the second concave portion 31*a*. In other words, the press member 30 rotates on a fulcrum where the second concave portion 31*a* contacts the first convex portion 21*c* by engaging the second concave portion 31*a* with the first convex portion 21*c*, and the press member 30 rotates on a fulcrum where the second convex portion 31*b* is contacted with the first concave portion 21*d* by engaging the second convex portion 31*b* with the first concave portion 21*d*. In this embodiment, the fulcrum is located between the front end side and the rear end side of the press member 30, when the front end side of the press member 30 is pushed downwardly, the rear end side thereof moves upwardly and locks the press member 30, and when the rear end side of the press member 30 is pushed downwardly, the front end side thereof moves upwardly and releases the press member 30. Also, a press portion 31*c* for abutting against the first abutting portion 22*b* and the second abutting portion 22*c* of the contacts 20 is provided at the rotation support portion 31, the press portion 31*c* protrude in a chevron shape. Protruding portions 32 for regulating the lock members 50 from moving in the width direction are provided at both end sides in the width direction of the press member 30, and each of the protruding portions 32 protrude downwardly.

The fixing members 40 are made of a metal plate arranged at the both end sides in the width direction of the connector main body 10, each of the fixing members 40 are fixed to the both side face portions 13 of the connector main body 10. Connecting portions 41 which connect to a circuit board, which is not shown, are provided at the bottom end side of the fixing member 40, each of the connecting portions 41 extend outside in the width direction of the connector main body 10.

Each of the lock members 50 are made of a metal plate integrally formed with the fixing members 40, each of the lock members 50 is arranged at both ends side in the width direction of the connector main body 10. The lock members 50 comprise an engagement portion 51 for being engaged with the dented portion 1*a* of the flexible circuit 1, a movable portion 52 extending backwardly from the engagement portion 51, and a springy portion 53 extending to the fixing members 40 from the rear end of the movable portion 53. The engagement portion 51 and the movable portion 52 move toward the width direction of the connector main body 10 by the springy portion 53 deforming springy. Compared to the movable portion 52, the engagement portion 51 is formed in a chevron shape so as to protrude toward inside in the width direction of the connector main body 10, the movable portion 52 extends straight in the front-rear direction of the connector main body 10. The springy portion 53 extends toward the inside in the width direction of the connector main body 10 from the rear end of the movable portion 52, and the springy portion 53 is bent to extend toward the outside in the width direction of the connector main body 10 to the fixing members 40, the engagement portion 51 and the movable portion 52 move in the width direction of the connector main body 10 by deforming the springy portion 53 springy toward the front-rear direction of the connector main body 10. In this embodiment, when the springy portion 53 is not deformed, a slit into which the protruding portion 32 of the press member 30 can be inserted is provided between the movable portion 52 and the side face portion 13 of the connector main body 10, and when the movable portion 52 is moved toward the outside in the width direction of the connector main body 10, the protruding portion 32 abuts against the movable portion 52 so that the protruding portion 32 is regulated from being inserted in the slit.

Figure 5A:
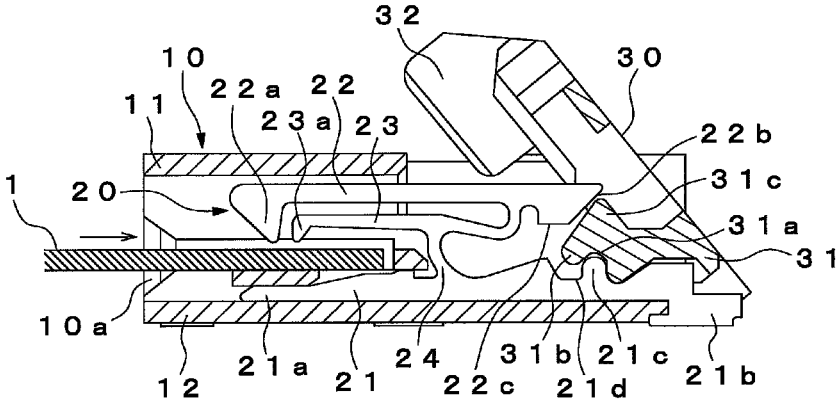
FIG. 5A is a side sectional view showing a closing operation of the connector.
Figure 5B:
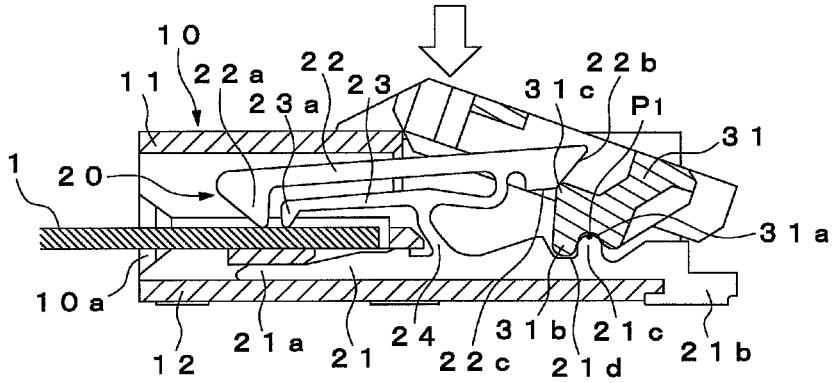
FIG. 5B is a side sectional view showing the closing operation of the connector.
Figure 5C:
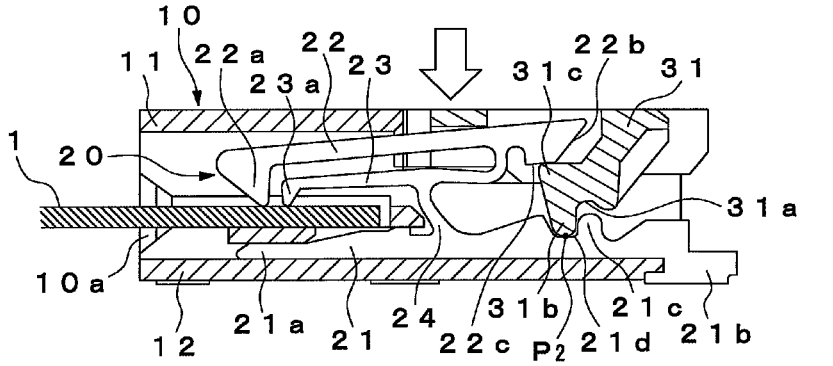
FIG. 5C is a side sectional view showing the closing operation of the connector.

For the above configured connector, as shown in FIG. 5A, while the press member 30 is released, the flexible circuit 1 is inserted into a predetermined position in the connector main body 10 from the insertion slot 10*a*, as shown in FIG. 5B, when the front end side of the press member 30 is pushed downwardly, while the second concave portion 31*a* of the press member 30 is engaged with the first convex portion 21*c*, the press member 30 rotates on a place where the second concave portion 31*a* contacts with the first convex portion 21*c* as a first rotation fulcrum P1, the press portion 31*c* of the press member 30 abuts with the first abutting portion 22*b* of the first movable piece portion 22 toward the front direction. At that time, the first abutting portion 22*b* inclines downwardly toward the front direction, thus, the rear end side of the first movable piece portion 22 is pushed upwardly and the front end side thereof is inclined due to the press portion 31*c*, and, in accordance with this, the rear end side of the second movable piece portion 23 is pushed upwardly and the front end side thereof is inclined. By this, the first contacting portion 22*a* and the second contacting portion 23*a* touch tightly the upper face of the flexible circuit 1, and each of the movable piece portions 22 and 23 is electrically connected to the flexible circuit 1. Next, as shown in FIG. 5C, when the front end side of the press member 30 is pushed further downwardly, the second convex portion 31*b* is engaged with the first concave portion 21*d*, the second concave portion 31*a* is detached from the first convex portion 21*c*, the press member 30 rotates on a place where the second convex portion 31*b* contacts with the first concave portion 21*d* as a second rotation fulcrum P2. By this, the rotation fulcrum of the press member 30 is shifted to the second rotation fulcrum P2 which is further from the press portion 31*c* than the first rotation fulcrum P1, thus, a press force of the press member 30 becomes larger, and the rear end side of the first movable piece portion 22 is pushed further upwardly. At this time, since an abutting position of the press portion 31*c* is shifted to the second abutting portion 22*c*, which is approximately horizontal from the first abutting portion 22*b*, by an abutting of the press portion 31*c* and the second contacting portion 22*c*, each of the movable piece portions 22 and 23 is held as being deformed, and the rotation of the press member 30 toward an opening direction is regulated. Also, due to a change in angles of each of the contacting portions 22*b* and 22*c*, it is possible to feel that the press member 30 is closed when the contacting position of the press portion 31*c* is shifted.

Figure 6A:
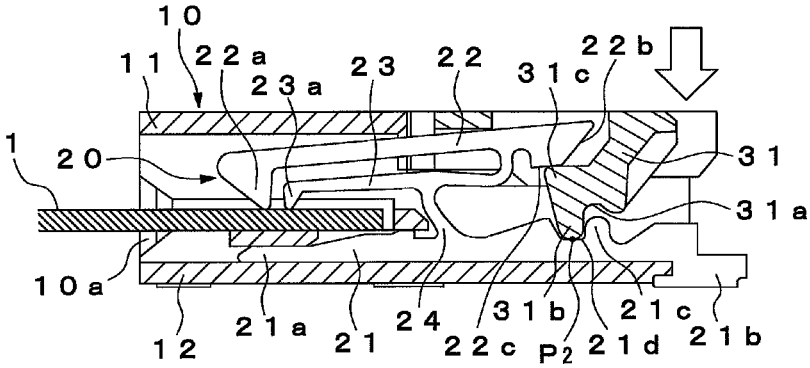
FIG. 6A is a side sectional view showing the opening operation of the connector.
Figure 6B:
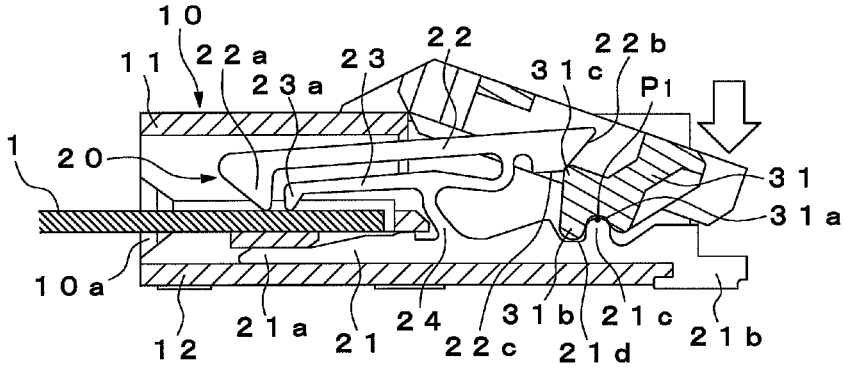
FIG. 6B is a side sectional view showing the opening operation of the connector.
Figure 6C:
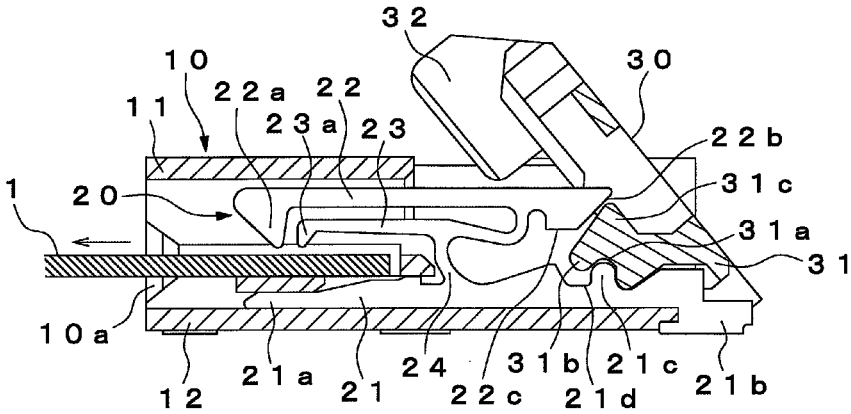
FIG. 6C is a side sectional view showing the opening operation of the connector.

Next, as shown in FIG. 6A, when the rear end side of the press member 30 is pushed downwardly, the second convex portion 31*a* of the press member 30 is engaged with the first convex portion 21*c* as shown in FIG. 6B, the press member 30 rotates on the first rotation fulcrum P1, the front end side of the press member 30 moves upwardly. At this time, the abutting position of the press portion 31*c* is shifted to the first abutting portion 22*b* from the second abutting portion 22*c*. Moreover, when the rear end side of the press member 30 is pushed further downwardly, the pushing member 30 rotates toward the opening direction as shown in FIG. 6C, and the abutting between the press portion 31*c* and the first abutting portion 22*b* is released. By this, the front end portions of the movable piece portions 22 and 23 are moved upwardly by a restoration force of the springy piece portion 24, the contacting portions 22*a* and 23*a* are detached from the flexible circuit 1 and each of the contacts is released, and the flexible circuit 1 can be extracted from the connector main body 10.

Figure 7A:
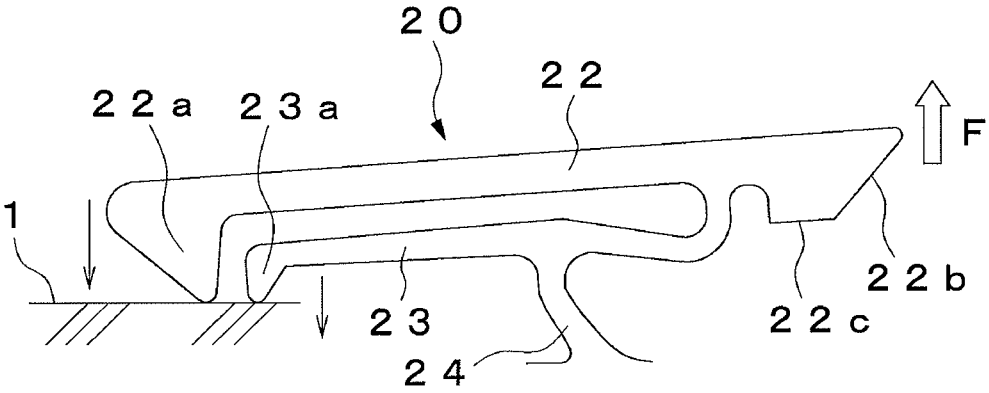
FIG. 7A is an explanatory view of an operation of a contact.
Figure 7B:
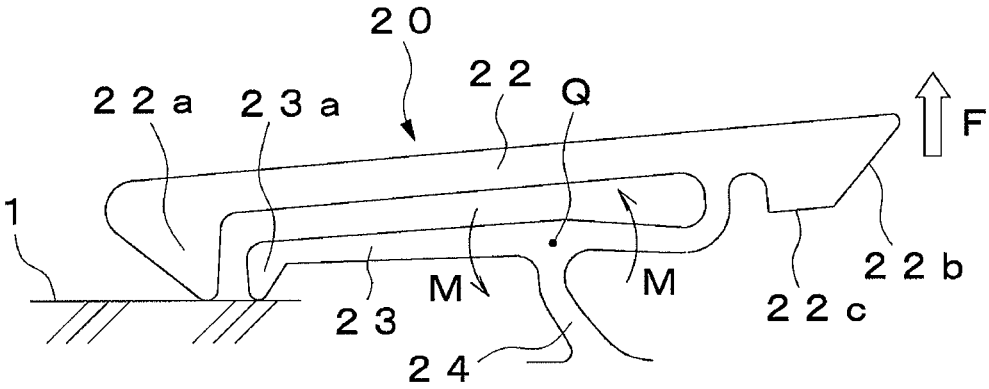
FIG. 7B is an explanatory view of an operation of the contact.

Operations of the contacts 20 when the press member 30 is closed is further explained, as shown in FIG. 7A, when an upward directed force F toward upwards is generated at the rear end side of the first movable piece portion 22, the first contacting portion 22*a* and the second contacting portion 23*a* are pressed to the upper face of the flexible circuit 1. After that, as shown in FIG. 7B, when a further upward directed force F is generated, the rear end side of the second movable piece portion 23 is moved up by the first movable piece portion 22, and a moment M around a fulcrum Q of the springy piece portion 24 as a center thereof is generated. By this, even after the contacting portions 22*a* and 23*a* are touched tightly the flexible circuit 1 respectively, a downward directed pressing force to the front end side of the second movable piece portion 23 increases, and a contact pressure of the second contacting portion 23*a* becomes higher.

Figure 8:
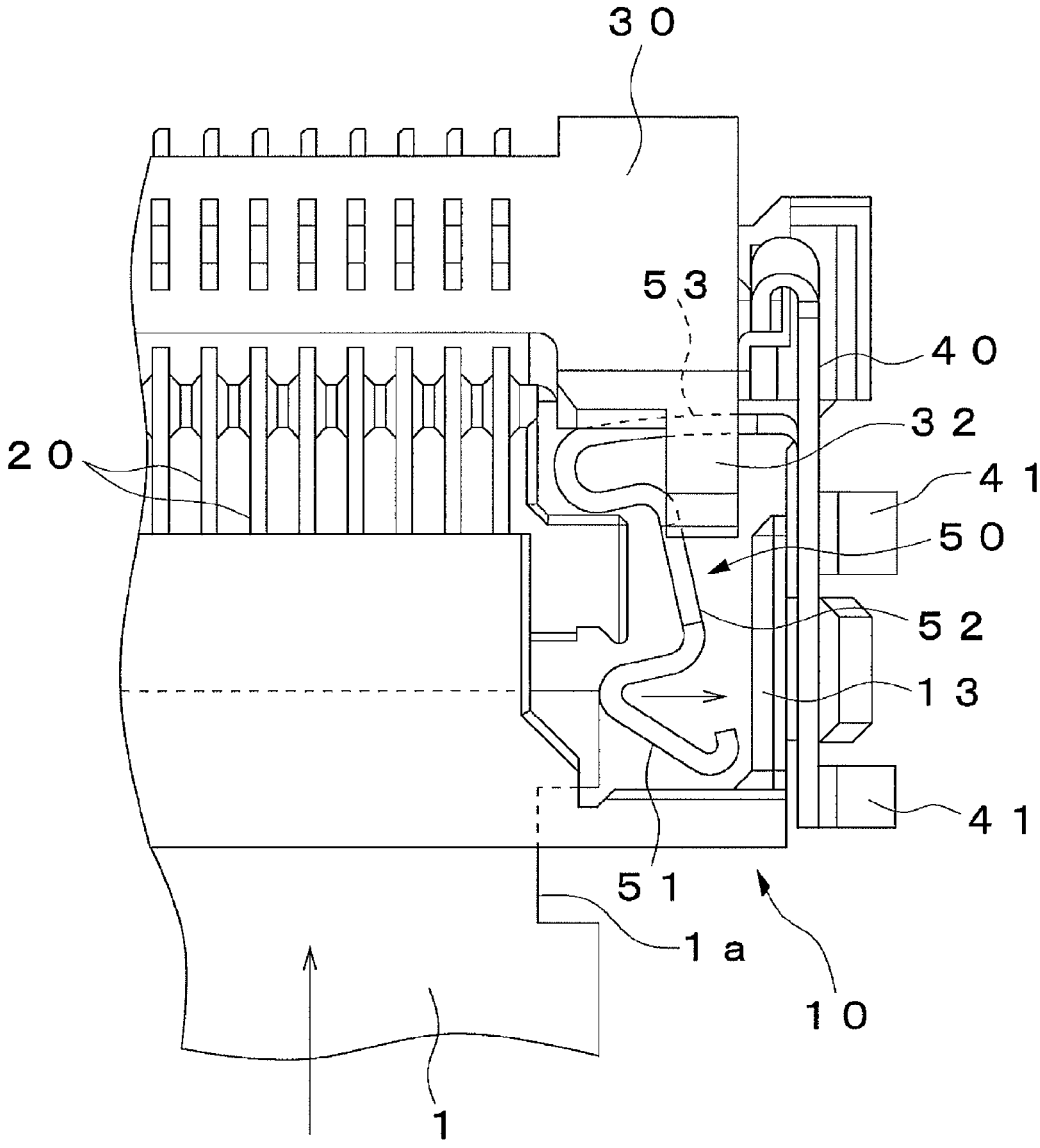
FIG. 8 is a partial plan view of the connector showing an operation of a lock member.
Figure 9:
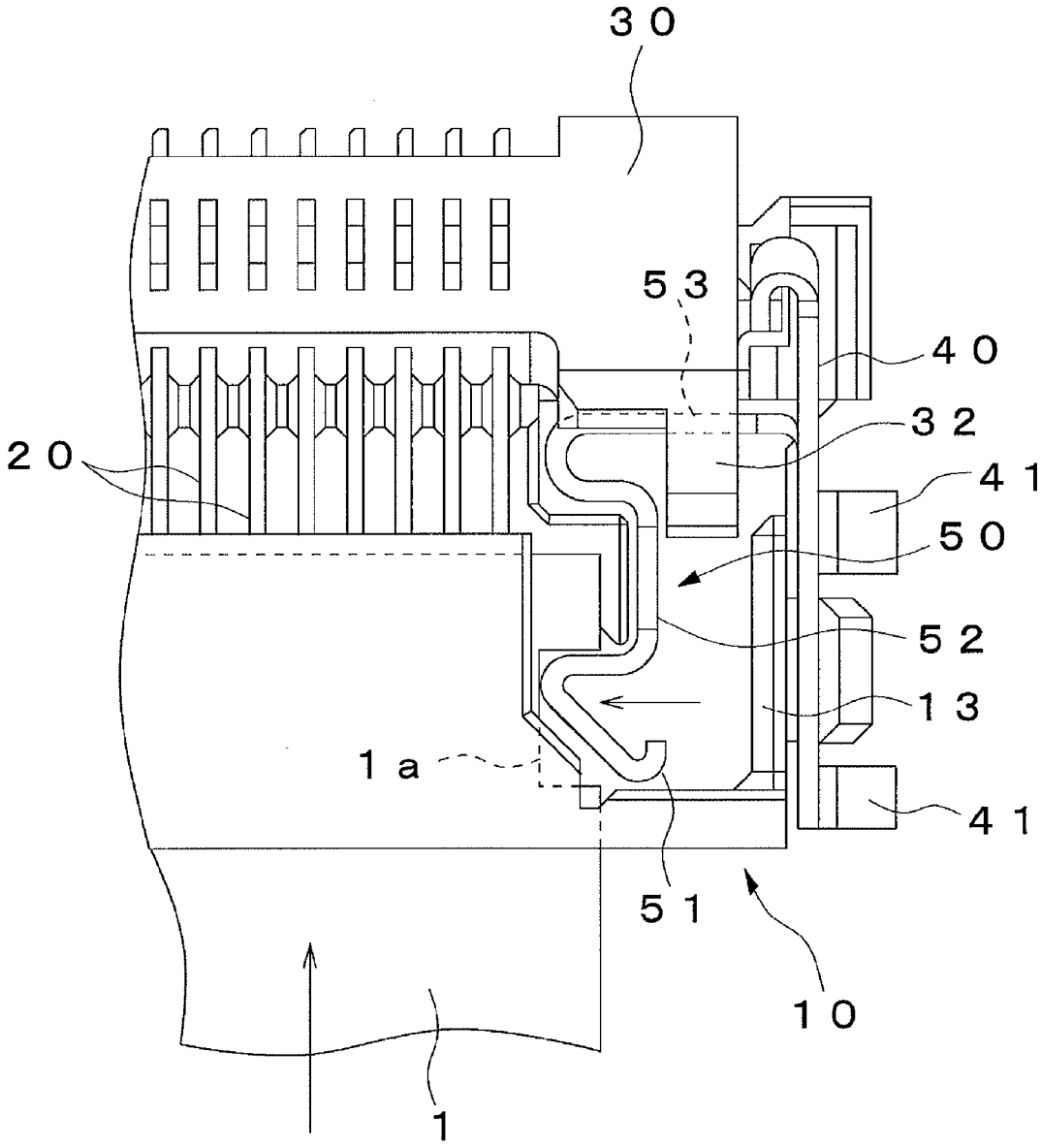
FIG. 9 is a partial plan view of the connector showing an operation of the lock member.
Figure 10:
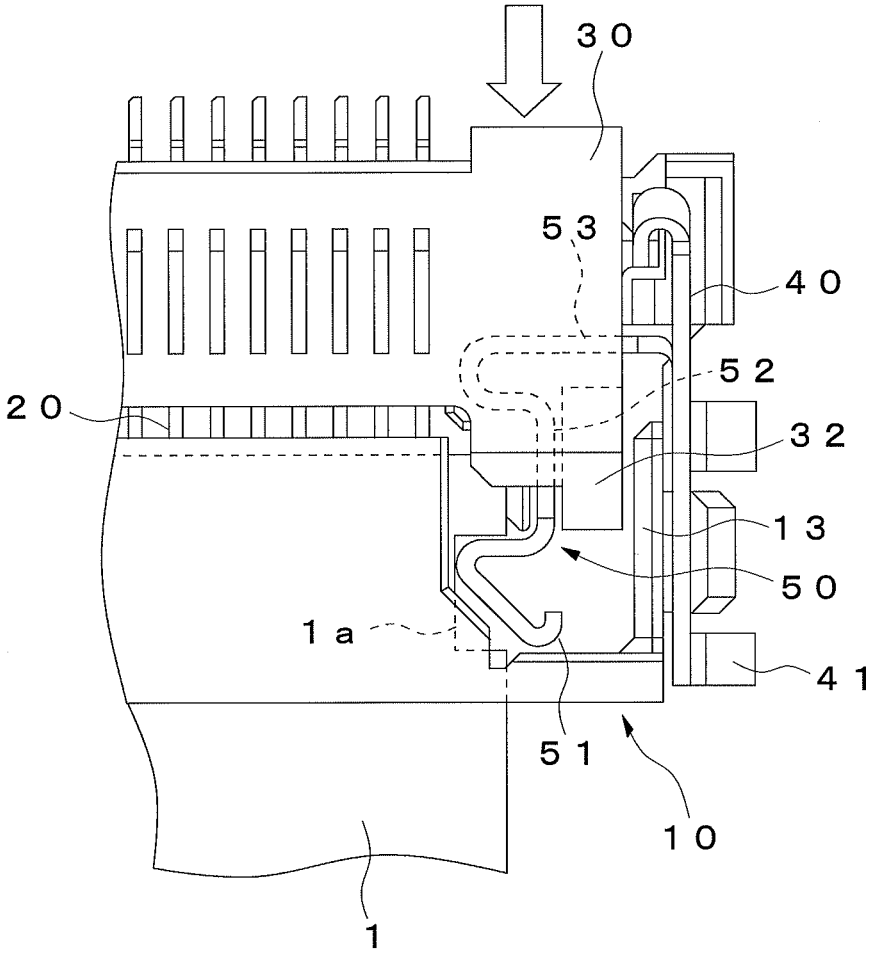
FIG. 10 is a partial plan view of the connector showing an operation of the lock member.
Figure 11:
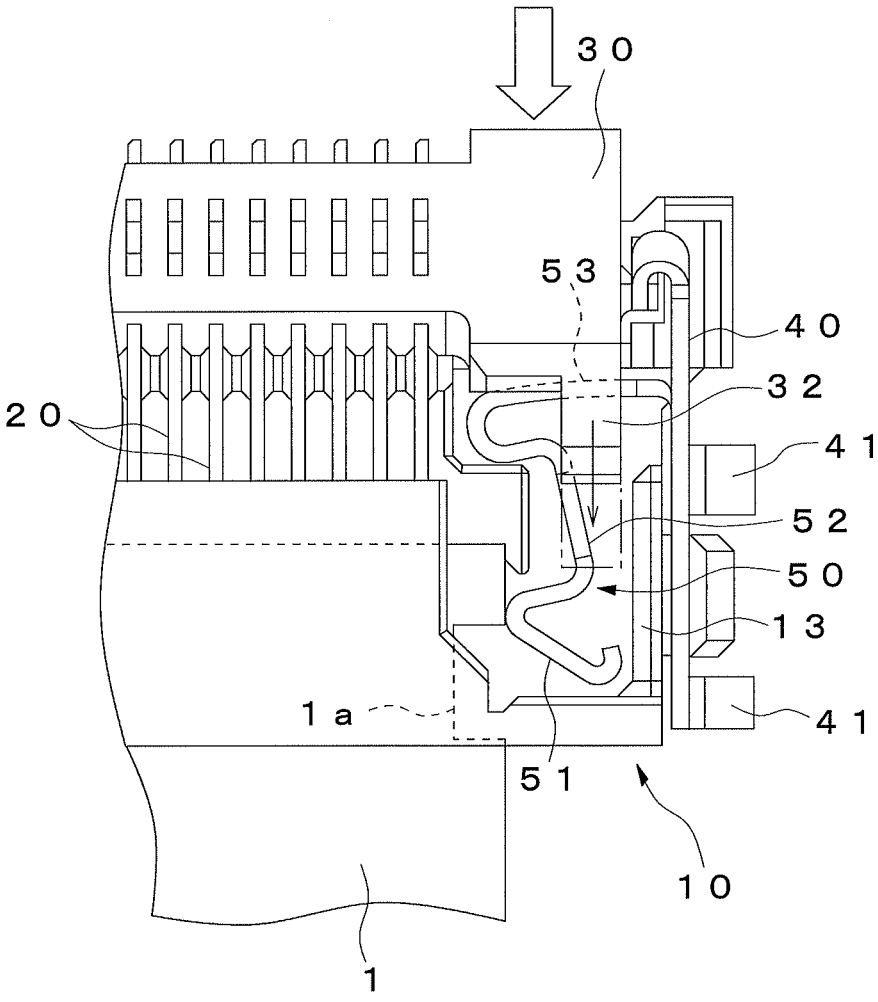
FIG. 11 is a partial plan view of the connector showing an operation of the lock member.

Also, when the flexible circuit 1 is inserted into the insertion slot 10*a* of the connector main body 10, the tip of the flexible circuit 1 abuts against the inclined face of the engagement portion 51 of the lock members 50, as shown in FIG. 8, the engagement portion 51 and movable portion 52 are moved toward outside in the width direction of the connector main body 10. Further, when the flexible circuit 1 is inserted into a predetermined position, as shown in FIG. 9, the engagement portion 51 is engaged with the dented portion 1*a* of the flexible circuit 1, and the engagement portion 51 and the movable portion 52 are moved toward inside in the width direction. By this, the connector main body 10 temporarily holds the flexible circuit 1 by the lock members 50. Next, when the press member 30 is rotated to the closed position, as shown in FIG. 10, the protrude portion 32 of the press member 30 is inserted between the movable portion 52 and the side face portion 13 of the connector main body 10. By this, a movement of the lock members 50 toward outside in the width direction of the lock member 50 is regulated by the protrude portion 32, the flexible circuit 1 becomes completely locked by the lock members 50. As is shown in FIG. 11, when the engagement portion 51 is not engaged with the dented portion 1*a* of the flexible circuit 1 because of an imperfect insertion of the flexible circuit 1, the press member 30 is rotated to the closed direction while the engagement portion 51 and the movable portion 52 are moved toward the outside in the width direction of the connector main body 10, the protrude portion 32 of the press member 30 abuts the movable portion 52, and the rotation of the press member 30 to the closed direction becomes regulated. This prevents the press member 30 from being rotated to the closed position when the flexible circuit 1 is imperfectly inserted.

As described above, according to the connector of the present embodiment, the contacts 20 are provided with a first movable piece portion 22 at the anterior end of which a first contacting portion 22*a* for contact with a flexible circuit 1 is included and the posterior end of which is pressed by the press member 30 in a direction opposite to the flexible circuit 1, the second movable piece portion 23 at the anterior end of which the second contacting portion 23*a* for contact with the flexible circuit 1 is included and the posterior end of which is formed integrally with the posterior end of the first movable piece portion 22, and the springy piece portion 24 for displacing the first and second movable piece portions 22 and 23 so that, when the posterior end of the first movable piece portion 22 is pressed by the press member 30, the first and second contacting portions 22*a* and 23*a* come into pressure contact with the flexible circuit 1. Consequently, the first and second contacting portions 22*a* and 23*a* can be brought into two-point contact with the flexible circuit 1 by pressing the contacts 20 by the press member 30. Accordingly, even if foreign matter becomes trapped between one of the first and second contacting portions 22*a* and 23*a* and the flexible circuit 1, thus causing a contact failure, in a case where, for example, the foreign matter adheres to the flexible circuit 1, it is possible to secure electrical conduction between the other contacting portion and the flexible circuit 1. Thus, it is possible to effectively prevent a connection failure.

In this case, the connector is adapted so that, when the posterior end of the first movable piece portion 22 is pressed by the press member 30, the moment M centered on the fulcrum Q of the springy piece portion 24 is generated in the second movable piece portion 23 by a pressing force of the press member 30 applied from the first movable piece portion 22 to the posterior end of the second movable piece portion 23, so as to increase the pressing force of the second contacting portion 23*a* exerted upon the flexible circuit 1. Consequently, the contact pressure of the second contacting portion 23*a* can be increased even after the first and second contacting portions 22*a* and 23*a* are brought into pressure contact with the flexible circuit 1. Thus, it is possible to more securely ensure the state of conduction with the flexible circuit 1.

In addition, the first and second contacting portions 22*a* and 23*a* are arranged at an interval from each other in the insertion/removal direction of the flexible circuit 1, so as to have contact with the same across-the-width positions of the flexible circuit 1. Consequently, two-point contact can be realized with the same width as that of a single contacting portion. Thus, it is possible to dispose the respective contacts 20 at the same pitch as that of an existing connector using single-point contacts.

In this case, the fixing piece portion 21, the respective movable piece portions 22 and 23, and the springy piece portion 24 are formed by punching a conductive metal plate in the thickness direction thereof, so that the width direction of these portions agrees with the thickness direction of the metal plate. Consequently, the contacts 20 can be formed to the same thickness as that of the metal plate. Thus, the connector is extremely advantageous in densely arranging the contacts 20 in the width direction of the connector.

Furthermore, the abutting position of the press member 30 shifts from a first abutting portion 22*b* of the contacts 20 to a second abutting portion 22*c* thereof in the course of the press member 30 being rotated to one rotational position. In addition, the respective movable piece portions 22 and 23 of the contacts 20 are displaced by the abutment of the first abutting portion 22*b* and the press member 30, and the respective movable piece portions and 23 are kept displaced by the abutment of the second abutting portion 22*c* and the press member 30. Thus, the press member 30 can be prevented from rotating in an opening direction by the abutment of the press member 30 and the second abutting portion 22*c*. Consequently, it is possible to securely maintain the closed state of the press member 30. At that time, a sense of operation that the press member 30 has been closed can be gained when the abutting position of the press member 30 shifts due to the angular changes of the respective abutting portions 22*b* and 22*c*. Consequently, it is possible to confirm by the sense of operation that the press member 30 has been securely closed.

Yet furthermore, the first convex portion 21*c* and the first concave portion 21*d* with which the press member 30 rotatably engages are provided in a fixing piece portion 21 of the contacts 20. Consequently, it is possible to securely maintain the relative positions of the contacts 20 and the press member 30. Thus, the respective movable piece portions 22 and 23 of the contacts 20 can be precisely operated by the press member 30.

REFERENCE SIGNS LIST

1 . . . Flexible circuit 1, 1*a* . . . Dented portion, 20 . . . Contact, 21 . . . Fixing piece portion, 21*c* . . . First convex portion, 21*d* . . . First concave portion, 22 . . . First movable piece portion, 22*a* . . . First contacting portion, 22*b* . . . First abutting portion, 22*c* . . . Second abutting portion, 23 . . . Second movable piece portion, 23*a* . . . Second contacting portion, 24 . . . Springy piece portion, 40 . . . Fixing member, 50 . . . Lock member.

The invention claimed is:

1. An electrical connector comprising:

a connector main body into which an external conductive object is connected, a plurality of contacts disposed at intervals from one another within the connector main body in a width direction thereof, and a freely rotatable press member for pressing respective contacts against the external conductive object to be inserted into the connector main body, wherein the press member presses the respective contacts toward the external object to be connected when the press member rotates in one direction and cancel the press of the respective contacts when the press member rotates in the other direction, and at least one of the contacts comprising:

a first movable piece portion comprising:

a first contacting portion of one end of the first movable piece portion for contact with the external object to be connected, and an other end of the first movable piece portion is pressed by the press member in a direction opposite to the external object to be connected, a second movable piece portion comprising:

a second contacting portion of one end of the second movable piece portion for contact with the external object to be connected, and an other end of the second movable piece portion is formed integrally with the other end of the first movable piece portion, and a springy piece portion for displacing the first and second movable piece portions so that, when the other end of the first movable piece portion is pressed by the press member, the first and second contacting portions come into pressure contact with the external object to be connected, wherein a fixing piece portion connected to the first and second portions by the springy piece portion.

2. The connector according to claim 1, wherein the springy piece portion is formed so as to support a part between a second contacting portion and the other end of the second movable piece portion and, when the other end of the first movable piece portion is pressed by the press member, a moment centered on a fulcrum of the springy piece portion is generated in the second movable piece portion by a pressing force of the press member applied from the first movable piece portion to the other end of the second movable piece portion, so as to increase the pressing force of the second contacting portion exerted upon the external object to be connected.

3. The connector according to claim 1, wherein the first and second contacting portions are arranged at a staggered interval from each other in the insertion/removal direction of the external object to be connected.

4. The connector according to claim 1, wherein the fixing piece portion is formed from a conductive metal plate.

5. The connector according to claim 1, wherein a posterior end of the first movable piece portion of the contacts is provided with a first and a second abutting portion against which the press member abuts, wherein:

an abutting position of the press member shifts from the first abutting portion to the second abutting portion when the press member is rotated to one rotational position, and the first abutting portion being formed so that the contacts are displaced by the abutment of the press member, the second abutting portion being formed so that the contacts are kept displaced by the abutment of the press member.

6. The connector according to claim 1, wherein an engagement portion with which the press member rotatably engages is provided in the contacts.

7. The connector according to claim 6, wherein the engagement portion includes a first convex portion and a first concave portion provided in the contacts and a second concave portion and a second convex portion provided in the press member, so that the press member rotates with a contacting portion of the first convex portion and the second concave portion as a first rotation fulcrum as the result of the first convex portion and the second concave portion engaging with each other, and that the press member rotates with a contacting portion of the first concave portion and the second convex portion as a second rotation fulcrum as the result of the first concave portion and the second convex portion engaging with each other.

8. An electrical connector comprising:

a connector main body into which an external conductive object is connected, a plurality of contacts disposed at intervals from one another within the connector main body in a width direction thereof, and a freely rotatable press member for pressing respective contacts against the external object to be inserted into the connector main body, wherein the press member presses the respective contacts toward the external object to be connected if the press member rotates in one direction and cancel the press of the respective contacts if the press member rotates in the other direction, and at least one of the contacts comprising:

a first movable piece portion comprising:

a first contacting portion of one end of the first movable piece portion for contact with the external object to be connected, and an other end of the first movable piece portion is pressed by the press member in a direction opposite to the external object to be connected, a second movable piece portion comprising:

a second contacting portion of one end of the second movable piece portion for contact with the external object to be connected, and an other end of the second movable piece portion is formed integrally with the other end of the first movable piece portion, and a springy piece portion connected to the first and second portions for displacing the first and second movable piece portions so that, if the other end of the first movable piece portion is pressed by the press member, the first and second contacting portions come into pressure contact with the external object to be connected, wherein a posterior end of the first movable piece portion of the contacts is provided with a first and a second abutting portion against which the press member abuts, wherein an abutting position of the press member shifts from the first abutting portion to the second abutting portion if the press member is rotated to one rotational position, and the first abutting portion being formed so that the contacts are displaced by the abutment of the press member, the second abutting portion being formed so that the contacts are kept displaced by the abutment of the press member.

9. An electrical connector comprising:

a connector main body into which an external conductive object is connected, a plurality of contacts disposed at intervals from one another within the connector main body in a width direction thereof, and a freely rotatable press member for pressing respective contacts against the external object to be inserted into the connector main body, wherein the press member presses the respective contacts toward the external object to be connected if the press member rotates in one direction and cancel the press of the respective contacts if the press member rotates in the other direction, and at least one of the contacts comprising:

a first movable piece portion comprising:

a first contacting portion of one end of the first movable piece portion for contact with the external object to be connected, and an other end of the first movable piece portion is pressed by the press member in a direction opposite to the external object to be connected, a second movable piece portion comprising:

a second contacting portion of one end of the second movable piece portion for contact with the external object to be connected, and an other end of the second movable piece portion is formed integrally with the other end of the first movable piece portion, a springy piece portion connected to the first and second portions for displacing the first and second movable piece portions so that, if the other end of the first movable piece portion is pressed by the press member, the first and second contacting portions come into pressure contact with the external object to be connected, and an engagement portion with which the press member rotatably engages is provided in the contacts, wherein the engagement portion includes a first convex portion and a first concave portion provided in the contacts and a second concave portion and a second convex portion provided in the press member, so that the press member rotates with a contacting portion of the first convex portion and the second concave portion as a first rotation fulcrum as the result of the first convex portion and the second concave portion engaging with each other, and that the press member rotates with a contacting portion of the first concave portion and the second convex portion as a second rotation fulcrum as the result of the first concave portion and the second convex portion engaging with each other.

* * * * *